US008651231B1

(12) United States Patent
McKeeth et al.

(10) Patent No.: US 8,651,231 B1
(45) Date of Patent: Feb. 18, 2014

(54) MUFFLER TUBE WITH FOLDED END TABS

(75) Inventors: Dave McKeeth, Black River Falls, WI (US); Allen Peterson, Black River Falls, WI (US); Monte Nestingen, Viroqua, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 29 days.

(21) Appl. No.: 13/544,154

(22) Filed: Jul. 9, 2012

Related U.S. Application Data

(62) Division of application No. 12/179,349, filed on Jul. 24, 2008, now Pat. No. 8,230,595.

(51) Int. Cl.
*F01N 1/00* (2006.01)

(52) U.S. Cl.
USPC ..... 181/255; 29/890.08; 181/227; 72/367.1

(58) Field of Classification Search
USPC ..... 29/890.08; 72/370.1, 370.12, 379.2, 72/368, 367.1; 493/70, 405; 181/255, 227
See application file for complete search history.

(56) References Cited

U.S. PATENT DOCUMENTS 5,216,809 A 6/1993 Abbott et al.
6,540,046 B1 4/2003 Schuhmacher et al.

*Primary Examiner* — David Bryant
*Assistant Examiner* — Moshe Wilensky
(74) *Attorney, Agent, or Firm* — Foley & Lardner LLP

(57) ABSTRACT

Muffler tubes and methods of forming muffler tubes are provided. In one example, a muffler tube has an end portion with a plurality of outwardly extending tabs, wherein the tabs are folded radially inwards to at least partially close the end portion of the tube.

29 Claims, 11 Drawing Sheets

MUFFLER TUBE WITH FOLDED END TABS

CROSS-REFERENCE TO RELATED APPLICATION

The present application is a divisional of co-pending U.S. patent application Ser. No. 12/179,349, filed Jul. 24, 2008, which application is incorporated herein by reference.

FIELD

The present application relates to mufflers, and particularly to muffler tubes and methods of forming muffler tubes, such as perforated muffler tubes having a closed end.

BACKGROUND

FIGS. 1-3 depict prior art arrangements for closing an end of a muffler tube, such as a perforated muffler tube for a side-in and side-out muffler. FIG. 1 depicts a prior art plug flange A fitted in the end of a muffler tube B. During assembly, the plug flange A is inserted into the end of the tube B and spot welded in place at weld points C. FIGS. 2 and 3 illustrate additional examples of prior art plug flanges D, E inserted into the end of tubes F, G, respectively, and spot welded in place.

SUMMARY

The inventors have identified several drawbacks associated with the above-described prior art muffler tubes and with prior art apparatus and methods for closing the end of such tubes. For example, prior art arrangements use more material than is actually necessary to close the end of the tubes. Also, assembly of prior art muffler tubes is labor intensive, as there is labor required to insert the plug flange into the tube and to spot weld the plug flange in place. Plug flanges constitute an additional part that requires inventory and storage prior to assembly with the tube.

Plug flanges also occupy space in the muffler tube that could otherwise be more efficiently used for perforations.

This application provides improved muffler tubes and methods of forming muffler tubes that overcome many disadvantages found in the prior art. In one example, a tube is formed that extends in an axial direction and that has an end with a plurality of outwardly extending tabs and the tabs are folded radially inward to at least partially close the end of the tube.

In another example, a method of forming a muffler tube includes the steps of (1) providing a sheet of material having first and second side portions and a top portion comprising a plurality of tabs, (2) folding the sheet of material about a longitudinal axis to form a tube wherein the side portions are adjacent each other, (3) connecting the first side portion to the second side portion, and (4) folding the tabs radially inward towards the longitudinal axis to at least partially close one end of the tube.

In further examples, the sheet of material is stamped or otherwise cut to form the plurality of tabs. The sheet of material may also be perforated prior to the step of folding the sheet of material about the longitudinal axis. In further examples, the tabs are folded radially inward by a cam mechanism that includes a plurality of cam blocks operable to move radially inward towards the longitudinal axis. The cam blocks may be operated in sequence to sequentially engage the tabs and fold the tabs inward towards the longitudinal axis. The tabs may be sized and shaped so as to overlap each other when the cam blocks are operated in sequence. In this type of arrangement, the tube may be placed on a post prior to operating the cam mechanism. The post may have a top surface that engages the tabs as the tabs are folded by the cam mechanism. The top surface may be curved to thereby form the tabs into a corresponding curved shape when the tabs engage the top surface. A center block may be operated to move along the longitudinal axis and engage the shape of the folded tabs at the end of the tube.

In another example, a muffler tube includes an end portion with a plurality of outwardly extending tabs, wherein the tabs are folded radially inward to at least partially close the end portion of the tube In a further example, a muffler tube is provided that includes a sheet of material that is folded about a longitudinal axis into the shape of a tube that has an end portion with a plurality of outwardly extending tabs. The tabs are folded inward towards the longitudinal axis to at least partially close the end portion of the tube. In further examples, the tabs can overlap and define an aperture in the end portion of the tube.

BRIEF DESCRIPTION OF THE DRAWINGS

The best mode of carrying out the invention is provided with reference to the following drawing figures.

DETAILED DESCRIPTION OF THE DRAWINGS

Figure 1:
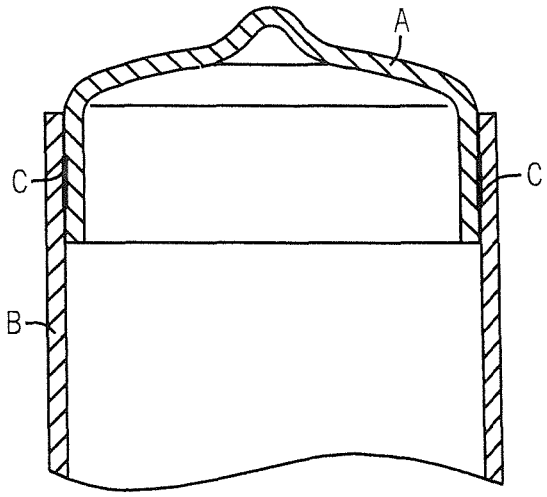
FIG. 1 PRIOR ART
FIG. 1 depicts a prior art muffler tube having an end that is closed by a plug flange having a dimple.
Figure 2:
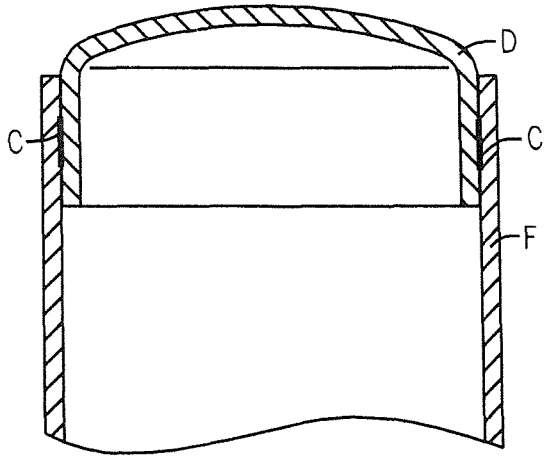
FIG. 2 PRIOR ART
FIG. 2 depicts a prior art muffler tube having an end that is closed by a plug flange.
Figure 3:
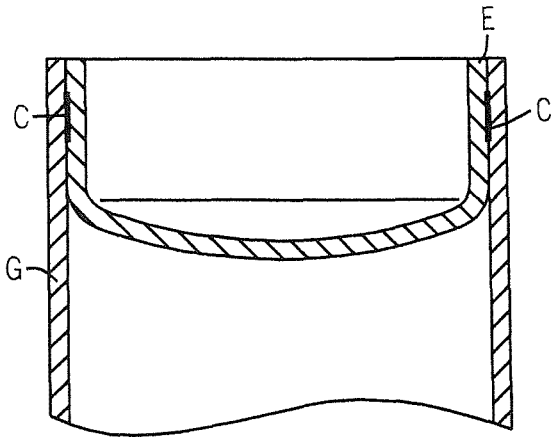
FIG. 3 PRIOR ART
FIG. 3 depicts a prior art muffler tube having an end that is closed by an inverted plug flange.
Figure 4:
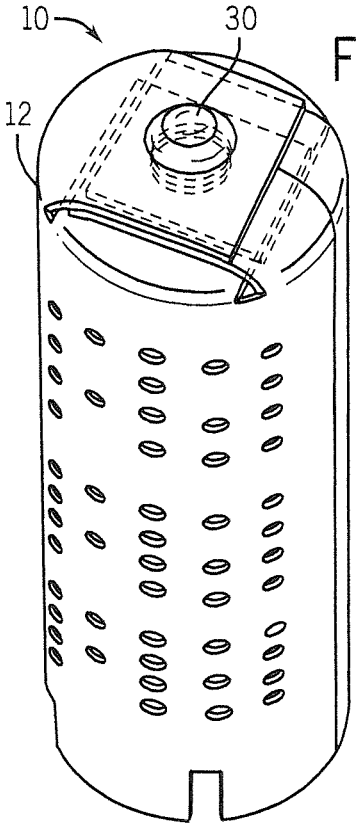
FIG. 4 is a perspective view of a muffler tube having an end that is closed by folded tabs.

In the following description, certain terms have been used for brevity, clearness and understanding. No unnecessary limitations are to be implied therefrom beyond the requirement of the prior art because such terms are used for descriptive purposes only and are intended to be broadly construed. The different muffler tubes and method steps described herein may be used alone or in combination with other apparatus, systems and method steps. It is to be expected that various equivalents, alternatives and modifications are possible within the scope of the appended claims.

The drawing figures depict exemplary perforated muffler tubes. Each of the examples utilize a sheet of material to form a tube. However it will be recognized that the invention is not limited to the use of a sheet of material. That is, the invention is applicable to formed, seamless tubes. In addition, each of the examples utilizes a sheet of material having four tabs extending outwardly from a top portion of the sheet of material. One of the four tabs is divided in half by a weld seam formed when the sheet of material is formed into a tube. It should be recognized, however, that the presently claimed invention is not limited to using a sheet of material having only four tabs. More or fewer tabs can be used and the specific configuration of the tabs in the plurality can be altered within the scope of the presently claimed invention. It is not necessary that any of the tabs be divided by a weld seam. Many of the examples show tabs having apertures or dimples; however it should be recognized that the location and number of apertures or dimples can vary to from that shown. Also, the sizes and shapes of the tabs can vary widely from that shown.

Figure 5:
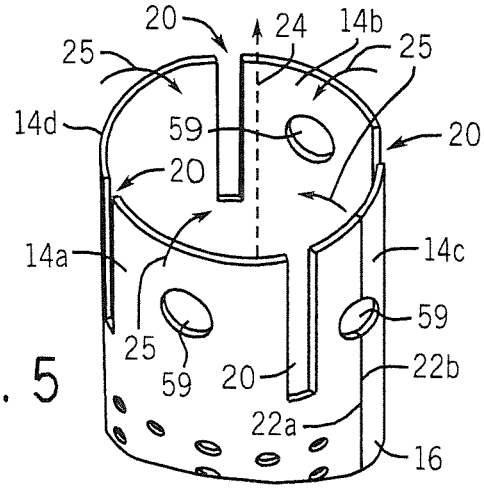
FIG. 5 is a perspective view showing the muffler tube of FIG. 4 with the tabs in an unfolded position.
Figure 6:
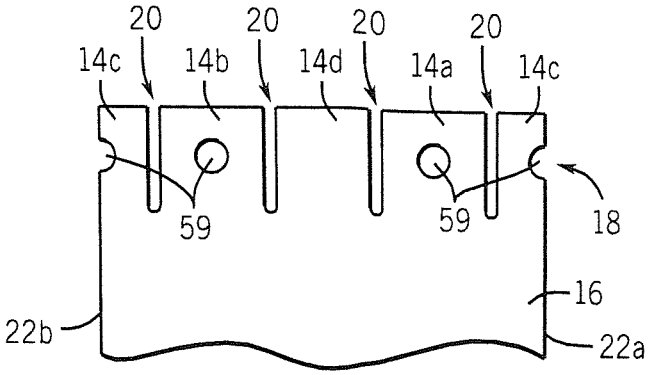
FIG. 6 is a front view of a sheet of material having tabs for forming the muffler tube of FIG. 4.
Figure 7:
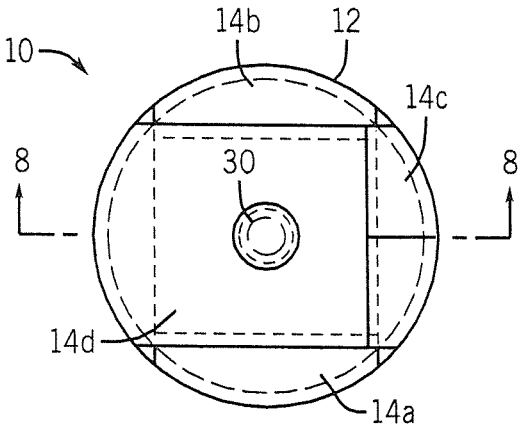
FIG. 7 is a top view of the muffler tube of FIG. 4.
Figure 8:
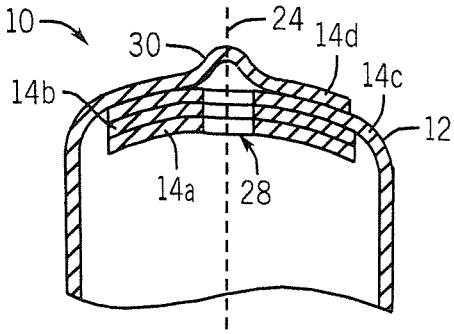
FIG. 8 is a view of Section 8-8 taken in FIG. 7.
Figure 9:
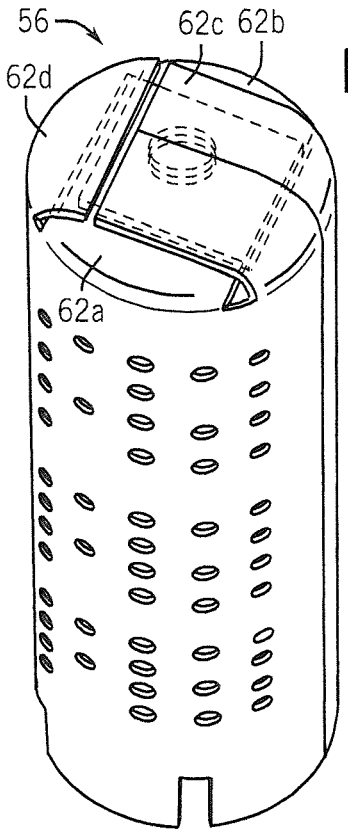
FIG. 9 is a perspective view of a muffler tube having an end that is closed by folded tabs.

FIGS. 4-8 depict one example of a perforated muffler tube 10 having an end 12 that is closed by a plurality of folded tabs 14*a*-14*d*. FIGS. 5 and 6 show the muffler tube 10 during the formation process.

As shown in FIG. 6, a sheet 16 of metal or other suitable material is provided. The sheet 16 can be punched in a die process or the like, cut, or otherwise formed to have a top portion 18 with the plurality of outwardly extending tabs 14*a*-14*d*. Each tab is separated from adjacent tabs in the plurality by a slot 20. In the example shown, the tab 14*c* is formed out of two smaller tabs located on opposite side portions 22*a*, 22*b* of the sheet 16. As shown in FIG. 5, the sheet 16 is folded about a longitudinal axis 24 such that the side portions 22*a*, 22*b* are located adjacent each other. The side portions 22*a*, 22*b* are then connected to each other by welding or the like. Thereafter, the tabs 14*a*-14*d* are folded radially inward in the direction of arrows 25 towards the longitudinal axis 24 to close the end 12 of the tube 10. In the example shown, the tab 14*a* is folded inward, followed by the tabs 14*b*, 14*c*, and lastly 14*d*. Each tab 14*a*-14*d* has a height 15 that is large enough so that the tabs 14*a*-14*b* overlap when folded inward. The tabs 14*a*, 14*b*, and 14*c* each include a through-hole 59 which can be formed in the sheet 16 during the cutting process. The through-hole 59 on tab 14*c* is formed by corresponding recesses in the side portions 22*a*, 22*b*, which become aligned when the sheet of material 16 is folded about the axis 24. When the tabs 14*a*, 14*b*, and 14*c* are folded inward so as to overlap, the through-holes in each of the tabs 14*a*-14*c* are aligned, thus forming a passage 28. A dimple 30 is formed in the uppermost tab 14*d* during the folding process, as will be described further below. The dimple 30 is useful to locate the tube 10 in side-in and side-out muffler configurations.

Figure 43:
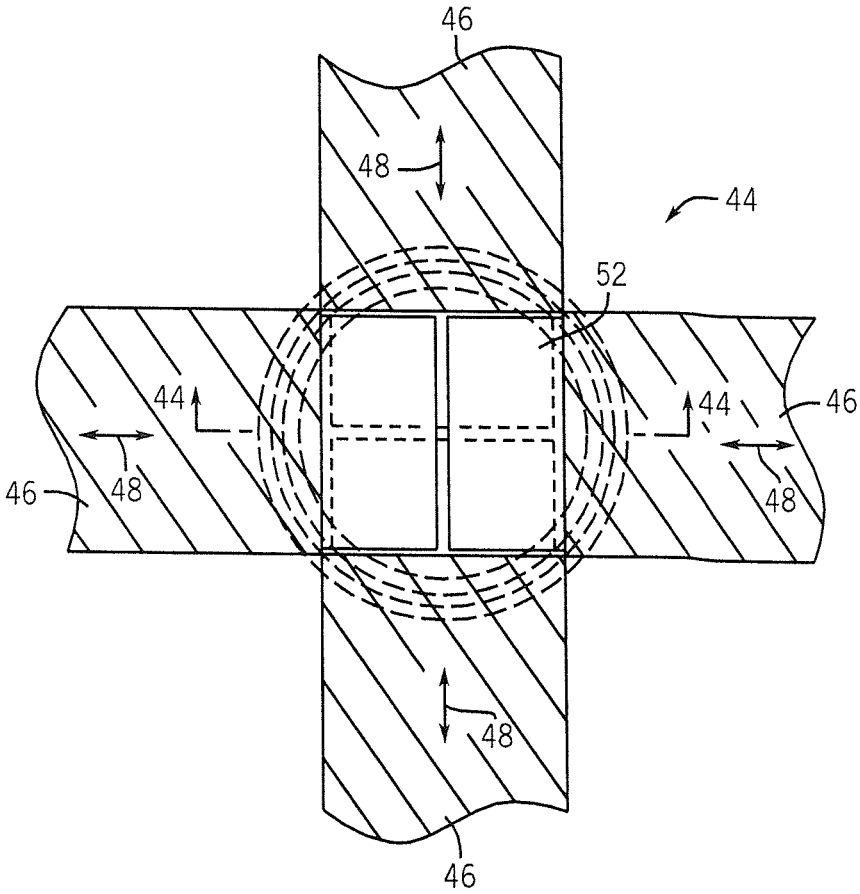
FIG. 43 is a top view of a cam mechanism and center block assembly for closing an end of a muffler tube.
Figure 44:
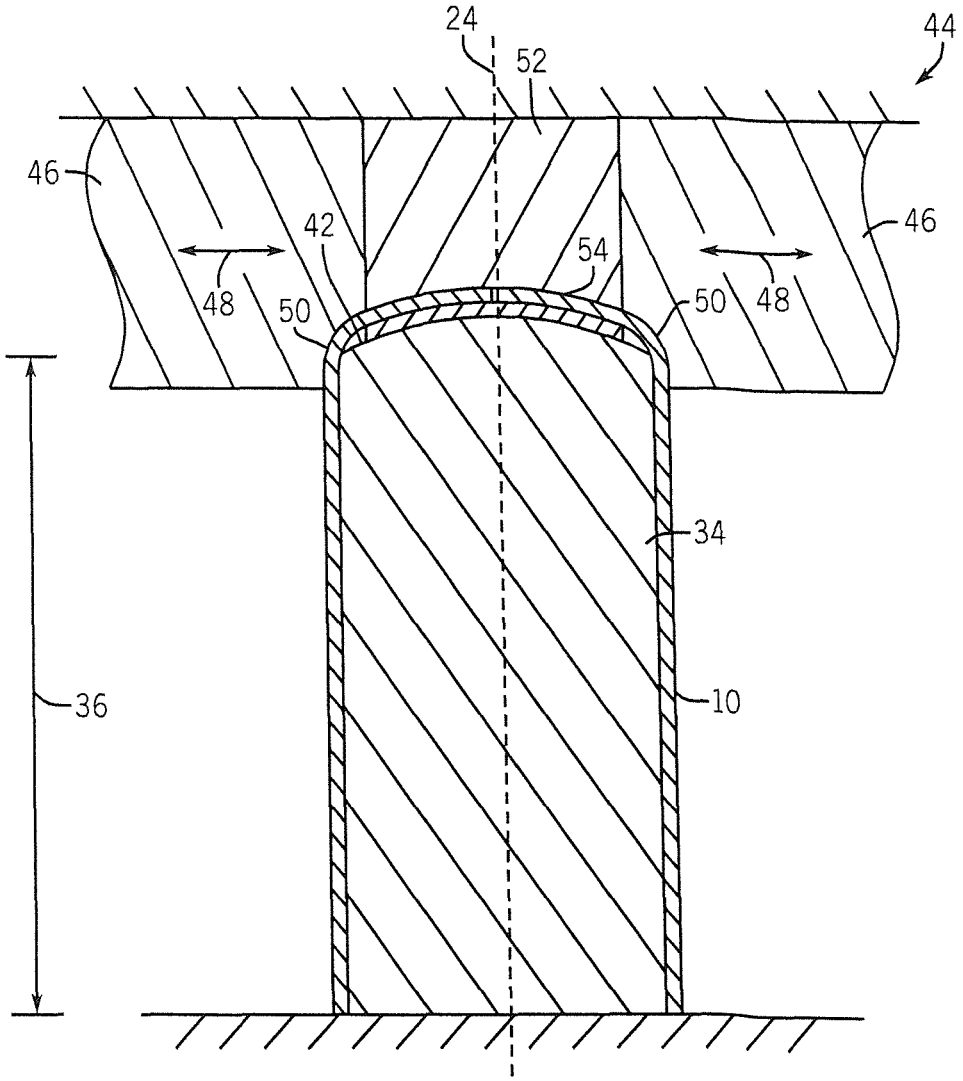
FIG. 44 is a view of Section 44-44 taken in FIG. 43.

FIGS. 43 and 44 depict apparatus for forming the muffler tube 10. Once the sheet 16 of material is folded and formed into the configuration shown in FIG. 10, it is placed onto a post 34 that has an outer circumference that is slightly smaller than the inner circumference of the tube 10. The post 34 has a height 36 that is substantially equal to the length of the muffler tube 10 between its lower end 38 and the lower end 40 of slots 20. The tabs 14*a*-14*d* thus extend above the top surface 42 of the post 34. A cam mechanism 44 is then operated to engage and cam or fold the tabs 14*a*-14*d* radially inward towards the longitudinal axis 24. The cam mechanism 44 includes a plurality of cam blocks 46 that are operable to move radially inward in the direction of arrows 48 towards the longitudinal axis 24. The cam blocks 46 each include an inner curved camming surface 50 that engages the tabs 14*a*-14*d* and causes the tabs to bend about the upper end of the post 34 and thus fold radially inward. Preferably, the cam blocks 46 are operated in sequence to sequentially engage the tabs 14*a*-14*d* and fold the tabs 14*a*-14*d* inward in the sequential order described above. Once or as the cam blocks 46 move in the direction of arrows 48, a center block 52 is operated to move down along the longitudinal axis 24 to engage the tabs 14*a*-14*d* and press the tabs 14*a*-14*b* onto the top surface 42 of the center block 52, and to sandwich the tabs 14*a*-14*d* therebetween, thus closing the end 12 of the muffler tube 10 with the folded tabs 14*a*-14*d*.

The top surface 42 of the post 34 and the bottom press surface 54 of the center block 52 can have a variety of configurations. In the example shown, the top surface 42 is convex and the press surface 54 is concave, thus causing the folded tabs 14*a*-14*d* to form into a convex curved shape. Alternatively, the press surface 54 can be concave and the top surface 42 can be convex, thus causing the tabs 14*a*-14*d* to form into a concave, curved shape. Alternative configurations for the respective top surface 42 and press surface 54 are also possible, as would be recognized in the art. A pin (not shown) can also be provided in the top surface 42 to form dimples 30 in one or more of the folded tabs 14*a*-14*d*, as shown in the embodiments described further below. The pin extends through the passage 28 and engages the inner surface of tab 14*d* to form the dimple 30 as the tab 14*d* is pressed onto the top surface 42.

FIGS. 9-42 depict further examples of perforated muffler tubes having an end that is closed by a plurality of folded tabs.

Figure 10:
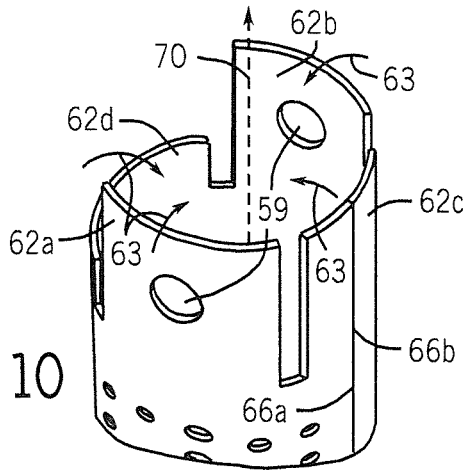
FIG. 10 is a perspective view showing the muffler tube shown in FIG. 9 with the tabs in an unfolded position.
Figure 11:
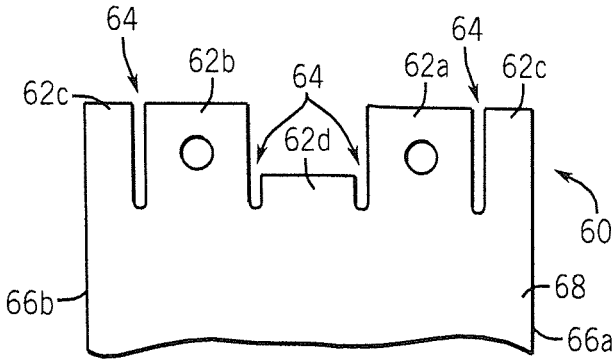
FIG. 11 is a front view of a sheet of material having tabs for forming the muffler tube of FIG. 9.
Figure 12:
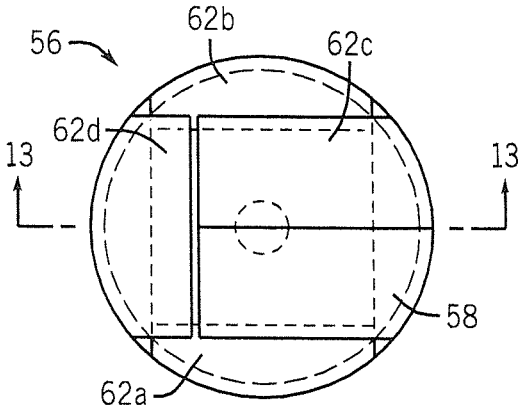
FIG. 12 is a top view of the muffler tube of FIG. 9.
Figure 13:
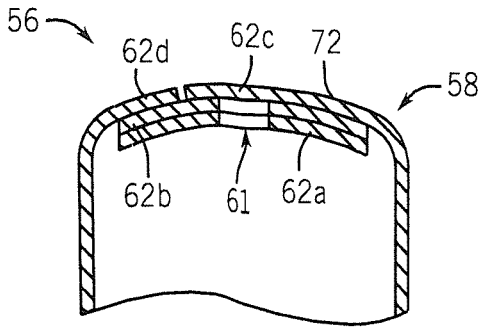
FIG. 13 is a view of Section 13-13 taken in FIG. 12.

FIGS. 9-13 depict a perforated muffler tube 56 having an end 58 that is closed by a plurality of folded tabs 62*a*-62*d*. FIGS. 10 and 11 show the muffler tube 56 during the formation process. As shown in FIG. 11, a sheet 68 of metal or other suitable material is punched in a die, cut, or otherwise formed to have a top portion 60 with a plurality of outwardly extending tabs 62*a*-62*d*. Each tab is separated from adjacent tabs in the plurality by a slot 64. The tab 62*c* is formed out of two smaller tabs located on opposing side portions 66*a*, 66*b*. As shown in FIG. 10, the sheet 68 of material is folded about a longitudinal axis 70 such that the side portions 66*a*, 66*b* are located adjacent each other. The side portions 66*a*, 66*b* are then connected to each other by welding or the like. Thereafter, the tabs 62*a*-62*d* are folded radially inward towards the longitudinal axis 70 along arrows 63 to close the end 58 of the tube 56. In the example shown, the tab 62*d* is shorter than the tabs 62*a*-62*c*. The tab 62*a* is folded inward first, followed by the tab 62*b*, 62*c*, and lastly by 62*d*. As shown in FIG. 13, the tabs 62*a* and 62*b* overlap and are overlapped by the tabs 62*c* and 62*d* which together form an outer layer 72. The tabs 62*a* and 62*b* include a through-hole 59 which can be formed during the cutting process. When the tabs 62*a* and 62*b* are folded inward so as to overlap, the through-holes 59 in each of the tabs are aligned, thus forming a passage 60.

Figure 14:
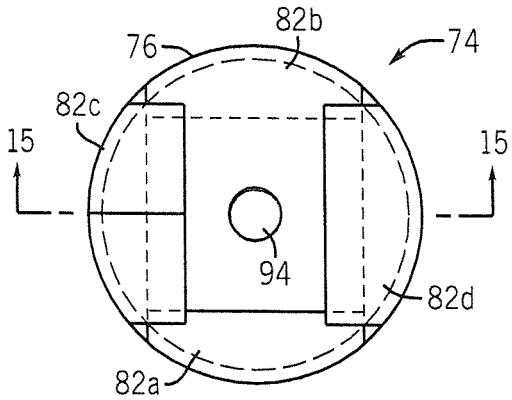
FIG. 14 is a top view of a muffler tube having an end that is closed by folded tabs.
Figure 15:
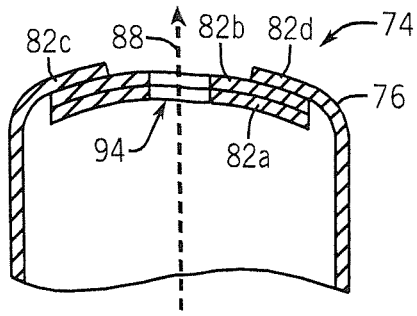
FIG. 15 is a view of Section 15-15 taken in FIG. 14.
Figure 16:
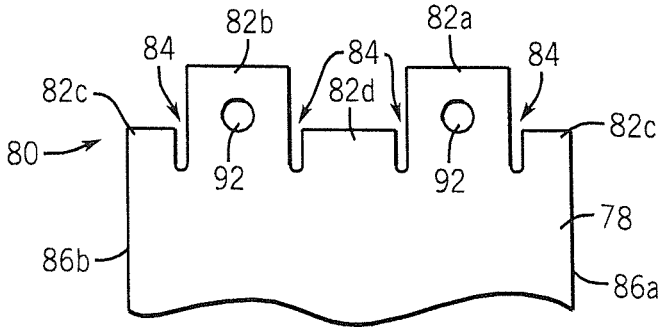
FIG. 16 is a front view of a sheet of material having tabs for forming the muffler tube of FIG. 14.

FIGS. 14-16 depict a perforated muffler tube 74 having an end 76 that is closed by a plurality of folded tabs 82*a*-82*d*. FIG. 16 shows a sheet 78 of metal or other suitable material that is punched in a die, cut or otherwise formed to have a top portion 80 with a plurality of outwardly extending tabs 82*a*-82*d*. Each tab is separated from adjacent tabs in the plurality by a slot 84. The tab 82*c* is formed out of two smaller tabs located on opposing side portions 86*a*, 86*b*. During manufacture, the sheet 78 of material is folded about a longitudinal axis 88 such that the side portions 86*a*, 86*b* are located adjacent each other. The side portions 86*a*, 86*b* are then connected to each other by welding or the like. Thereafter the tabs 82*a*-82*d* are folded radially inward towards the longitudinal axis 88 to close the end 76 of the tube 74. In the example shown, the tabs 82*c* and 82*d* are shorter in length than the tabs 82*a* and 82*b*. During formation, the tab 82*a* is folded inward first, followed by the tab 82*b*. Next, the tabs 82*c* and 82*d* are folded inward to overlap portions of the folded tabs 82*a*, 82*b*. The tabs 82*a*, 82*b* each include a through-hole 92 which can be formed during the cutting process. When the tabs 82*a* and 82*b* are folded inward so as to overlap, the through-holes 92 are aligned, thus forming a passage 94. The short length of the tabs 82*c* and 82*d* leaves the passage 94 open when all four tabs 82*a*-82*d* are folded inward.

Figure 17:
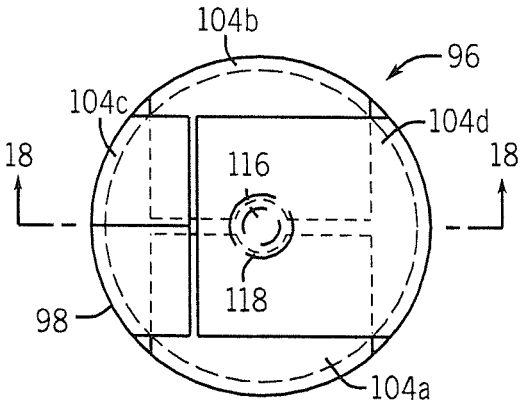
FIG. 17 is a top view of a muffler tube having an end that is closed by folded tabs.
Figure 18:
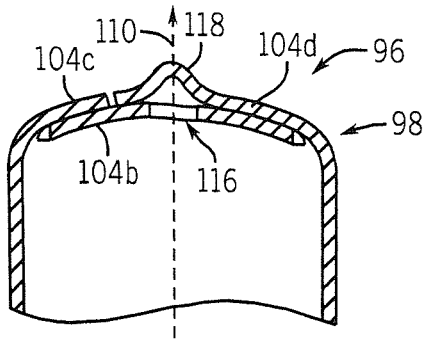
FIG. 18 is a view of Section 18-18 taken in FIG. 17.
Figure 19:
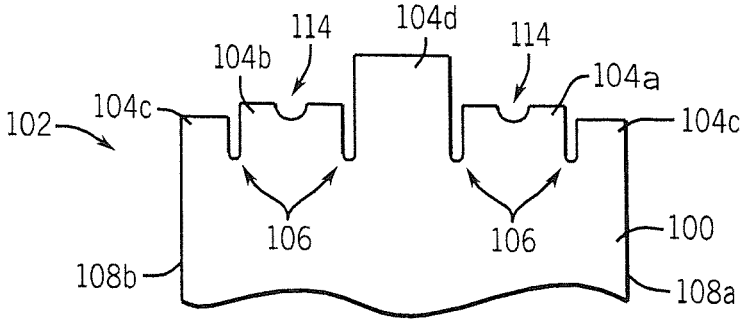
FIG. 19 is a front view of a sheet of material having tabs for forming the muffler tube of FIG. 17.

FIGS. 17-19 depict a muffler tube 96 having an end 98 that is closed by a plurality of folded tabs 104*a*-104*d*. FIG. 19 shows a sheet 100 of metal or other suitable material that is punched in die, cut, or otherwise formed to have a top portion 102 with a plurality of outwardly extending tabs 104*a*-104*d*. Each tab is separated from adjacent tabs in the plurality by a slot 106. The tab 104*d* is formed out of two smaller tabs located on opposing side portions 108*a*, 108*b*. The sheet 100 of material is folded about a longitudinal axis 110 such that the side portions 108*a*, 108*b* are located adjacent each other. The side portions 108*a*, 108*b* are then connected to each other by welding or the like. Thereafter, the tabs 104*a*-104*d* are folded radially inward towards the longitudinal axis 110 to close the end 98 of the tube 96. In the example shown, the tab 104*c* is slightly smaller than the tabs 104*a* and 104*b*. The tab 104*d* is slightly longer than the tabs 104*a* and 104*b*. During manufacture, the tabs 104*a* and 104*b* are folded inward towards the longitudinal axis 110. Each tab 104*a*, 104*b* includes an end portion 112 having a recess 114. When the tabs 104*a* and 104*b* are folded inward, the recesses 114 are aligned and define an aperture 116. Thereafter, the tabs 104*c* and 104*d* are folded to form a layer that overlaps the folded tabs 104*a* and 104*b*.

Figure 20:
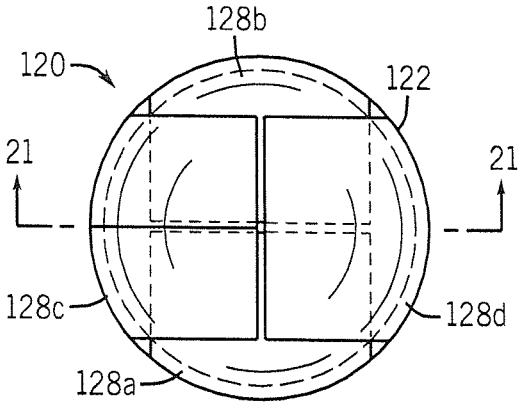
FIG. 20 is a top view of a muffler tube having an end that is closed by folded tabs.
Figure 21:
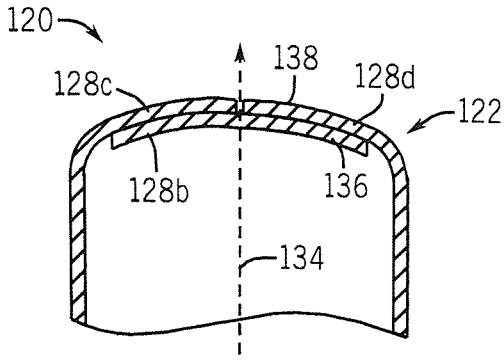
FIG. 21 is a view of Section 21-21 taken in FIG. 20.
Figure 22:
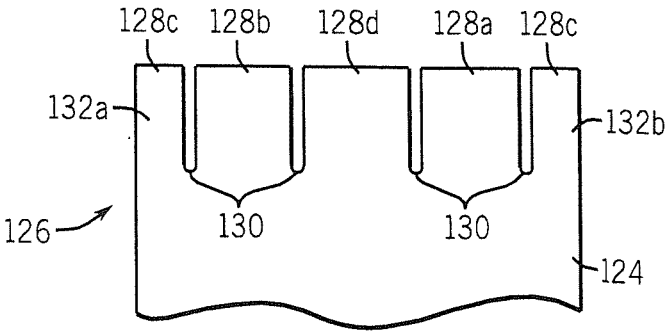
FIG. 22 is a front view of a sheet of material having tabs for forming the muffler tube of FIGS. 20 and 23.

FIGS. 20-22 depict another example of a perforated muffler tube 120 having an end 122 that is closed by a plurality of folded tabs 128*a*-128*d*. FIG. 22 shows a sheet 124 of metal or other suitable material that is punched in a die, cut, or otherwise formed to have a top portion 126 with a plurality of outwardly extending tabs 128*a*-128*d*. Each tab is separated from adjacent tabs in the plurality by a slot 130. The tab 128*c* is formed out of two smaller tabs located on opposing side portions 132*a*, 132*b*. The sheet 124 of material is folded about a longitudinal axis 134 such that the side portions 132*a*, 132*b* are located adjacent each other. The side portions 132*a*, 132*b* are then connected to each other by welding or the like. Thereafter, the tabs 128*a*-128*d* are folded radially inward towards the longitudinal axis 134 to close the end 122 of the tube 120. In the example shown, the tabs 128*a* and 128*b* are folded inward first to form a first end layer 136. The tabs 128*c* and 128*d* are then folded on top of the tabs 128*a* and 128*b* to overlap the tabs 128*a* and 128*b* and form a second end layer 138. The end layers 136 and 138 have a curved or is convex shape which can be formed by using a post 34 having a top surface 42 that is convex and a center block 52 having a press surface 54 that is concave (see FIG. 44).

Figure 23:
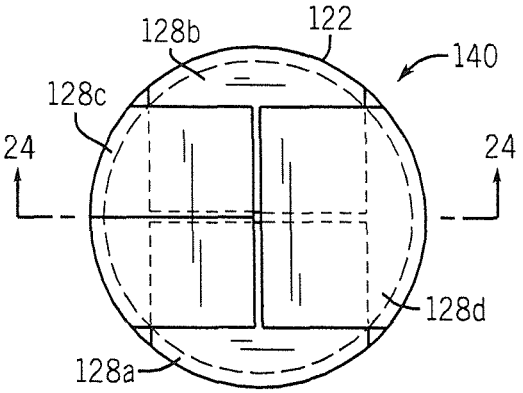
FIG. 23 is a top view of a muffler tube having an end that is closed by folded tabs.
Figure 24:
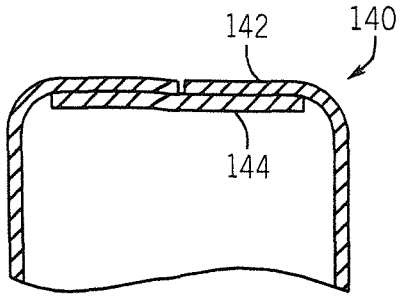
FIG. 24 is a view of Section 24-24 taken in FIG. 23.

FIGS. 23 and 24 show another example of a muffler tube 140 that is formed from a sheet of material 124 shown in FIG. 22. The muffler tube 140 has top and bottom end layers 142 and 144 that are flat and can be formed by using a post 34 having a top surface 42 that is flat along with a center block 52 having a press surface 54 that is flat.

Figure 25:
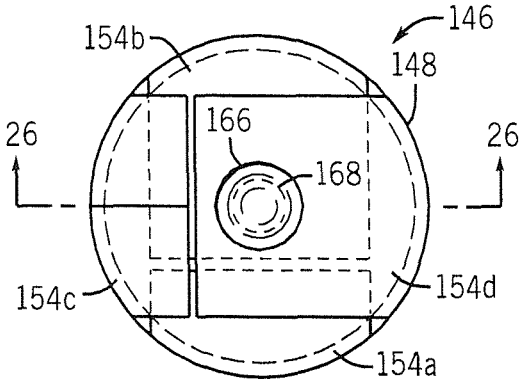
FIG. 25 is a top view of a muffler tube having an end that is closed by folded tabs.
Figure 26:
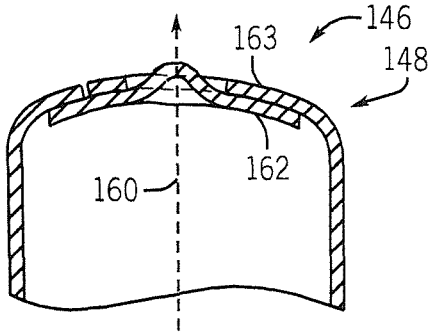
FIG. 26 is a view of Section 26-26 taken in FIG. 25.
Figure 27:
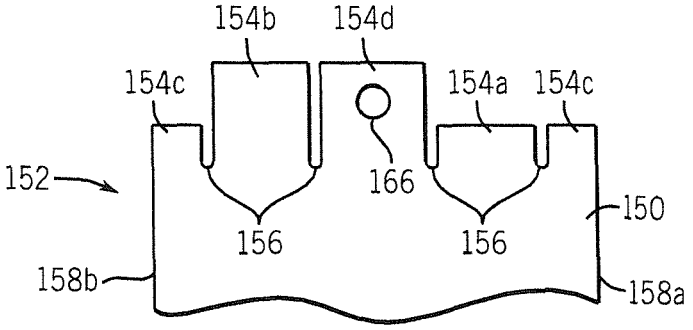
FIG. 27 is a front view of a sheet of material having tabs for forming the muffler tube of FIG. 25.

FIGS. 25-27 depict another example of a perforated muffler tube 146 having an end 148 that is closed by a plurality of folded tabs 154*a*-154*d*. FIG. 27 shows a sheet 150 of metal or other suitable material that is punched in a die, cut or otherwise formed to have a top portion 152 with a plurality of outwardly extending tabs 154*a*-154*d*. Each tab is separated from adjacent tabs in the plurality by a slot 156. The tab 154*c* is formed out of two smaller tabs located on opposing side portions 158*a*, 158*b*. The sheet 150 of material is folded about a longitudinal axis 160 such that the side portions 158*a*, 158*b* are located adjacent each other. The side portions 158*a*, 158*b* are then connected to each other by welding or the like. Thereafter, the tabs 154*a*-154*d* are folded radially inward towards the longitudinal axis 160 to close the end 148 of the tube 146. In the examples shown, the tab 154*b* has the same height as the tab 154*d*. The tabs 154*b* and 154*d* are longer than the tabs 154*a* and 154*c*. The tabs 154*a* and 154*c* have the same height. The tabs 154*a* and 154*b* are folded inward first, followed by the tabs 154*c* and 154*d*. As such the tabs 154*a* and 154*b* form an inner layer 162 and the tabs 154*c* and 154*d* form an outer layer 163 on the end 148 of the muffler tube 146. The tab 154*d* includes an aperture 166. The aperture 166 can be formed during the cutting process.

Figure 28:
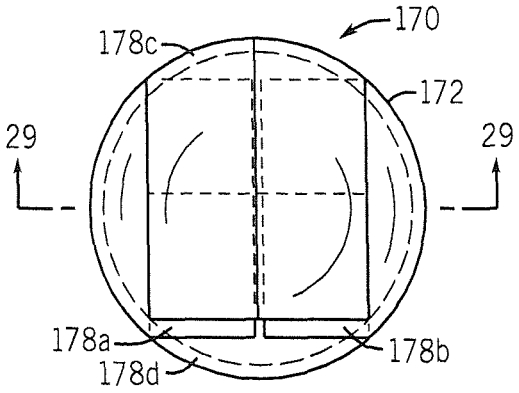
FIG. 28 is a top view of a muffler tube having an end that is closed by folded tabs.
Figure 29:
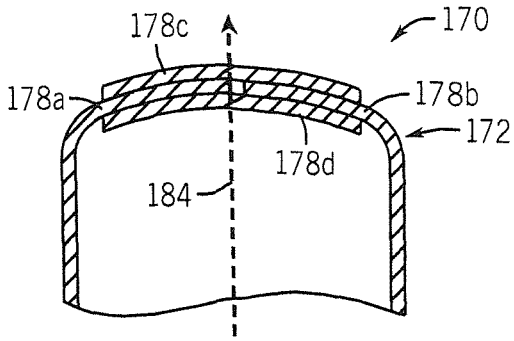
FIG. 29 is a view of Section 29-29 taken in FIG. 28.
Figure 30:
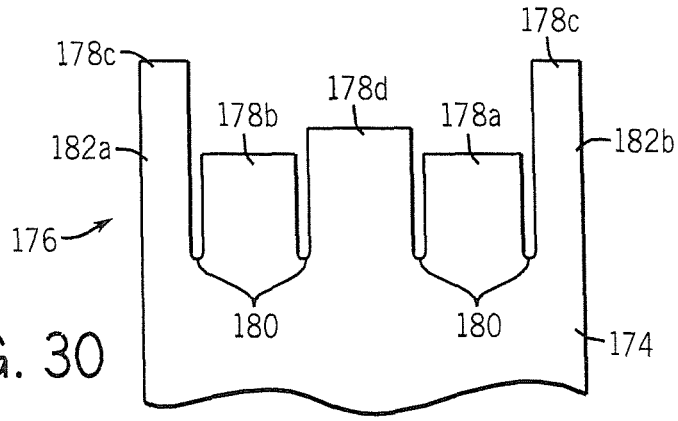
FIG. 30 is a front view of a sheet of material having tabs for forming the muffler tube of FIGS. 28 and 31.

FIGS. 28-30 depict another example of a perforated muffler tube 170 having an end 172 that is closed by a plurality of folded tabs 178*a*-178*d*. FIG. 30 shows a sheet 174 of metal or other suitable material is punched in a die, cut, or otherwise formed to have a top portion 176 with a plurality of outwardly extending tabs 178*a*-178*d*. Each tab is separated from adjacent tabs in the plurality by a slot 180. The tab 178*c* is formed out of two smaller tabs located on opposing side portions 182*a*, 182*b*. The sheet 174 of material is folded about a longitudinal axis 184 such that the side portions 182*a*, 182*b* are located adjacent each other. The side portions 182*a*, 182*b* are then connected to each other by welding or the like. Thereafter, the tabs 178*a*-178*d* are folded radially inward towards the longitudinal axis 184 to close the end 172 of the tube 170. In the examples shown, the tabs 178*a* and 178*b* are of substantially the same height, which is smaller than the height of tab 178*d*. The tab 178*c* has a height that is longer than all three of the remaining tabs 178*a*, 178*b*, and 178*d*. During formation, the tab 178*d* is folded inward first, followed by the tabs 178*a* and 178*b*. Thereafter, the tab 178*c* is folded inward. As shown in FIG. 29, this results in a closed end having three layers in cross section, wherein the layers 178*a* and 178*b* define a single middle layer. The end portion 172 has a convex shape which, as described above, can be formed by using a post 34 having a top surface 42 that is convex and a center block 52 having a press surface 54 that is concave.

Figure 31:
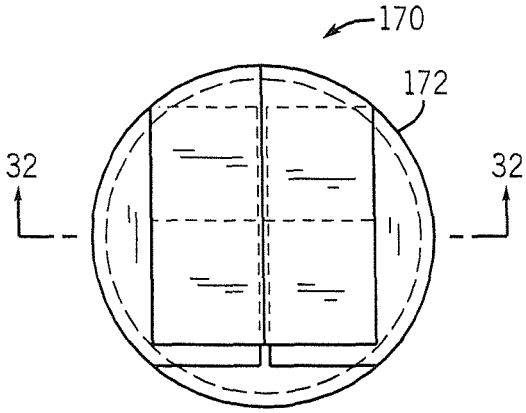
FIG. 31 is a top view of a muffler tube having an end that is closed by folded tabs.
Figure 32:
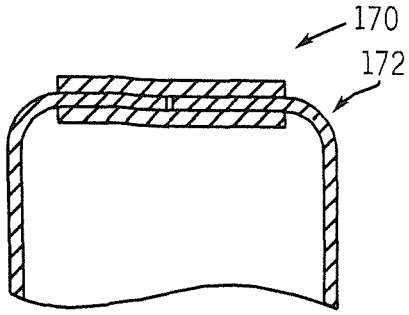
FIG. 32 is a view of Section 32-32 shown in FIG. 31.

Alternately, as shown in FIGS. 31 and 32, the end portion 172 can be flat if a post 34 having a flat top surface 42 and a center block 52 having a flat press surface 54 are used.

Figure 33:
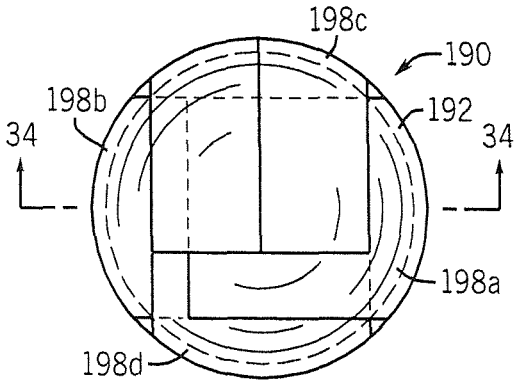
FIG. 33 is a top view of a muffler tube having an end that is closed by folded tabs.
Figure 34:
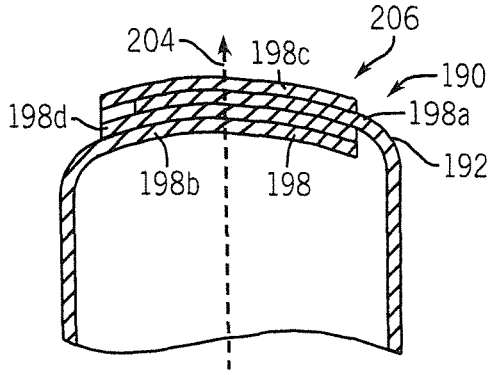
FIG. 34 is a view of Section 34-34 taken in FIG. 33.
Figure 35:
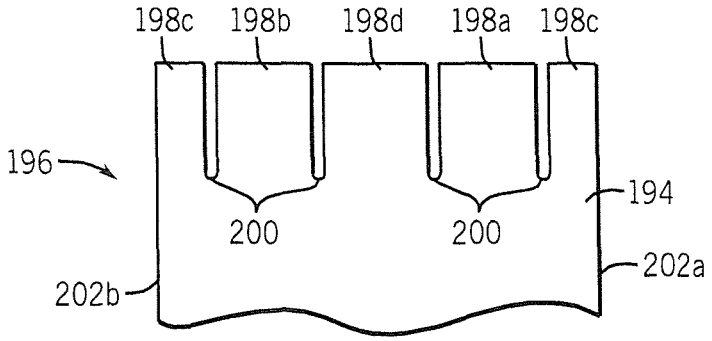
FIG. 35 is a front view of a sheet of material having tabs for forming the muffler tube of FIGS. 33, 36 and 38.

FIGS. 33-35 depict another example of a perforated muffler tube 190 having an end 192 that is closed by a plurality of folded tabs 198*a*-198*d*. FIG. 35 shows a sheet 194 of metal or other suitable material that is punched in a die, cut, or otherwise formed to have a top portion 196 with a plurality of outwardly extending tabs 198*a*-198*d*. Each tab is separated by adjacent tabs in the plurality by a slot 200. The tab 198*c* is formed out of two smaller tabs located on opposing side portions to 202*a*, 202*b*. The sheet 194 of material is folded about a longitudinal axis 204 such that the side portions 202*a*, 202*b* are located adjacent each other. The side portions 202*a*, 202*b* are then connected to each other by welding or the like. Thereafter, the tabs 198*a*-198*d* are folded radially inward towards the longitudinal axis 204 to close the end 192 of the tube 190. In the example, the tabs 198*a*-198*d* have the same height. The tab 198*b* is folded inward first, followed by the tabs 198*d*, 198*a*, and lastly by 198*c*. In this manner, the tabs 198*a*-198*d* overlap and define a four-layered end portion 206. The end portion has a curved or convex shape which, as described above, can be defined by using a post 34 have a top surface 42 that is convex and a center block 52 having a press surface 54 that is concave.

Figure 36:
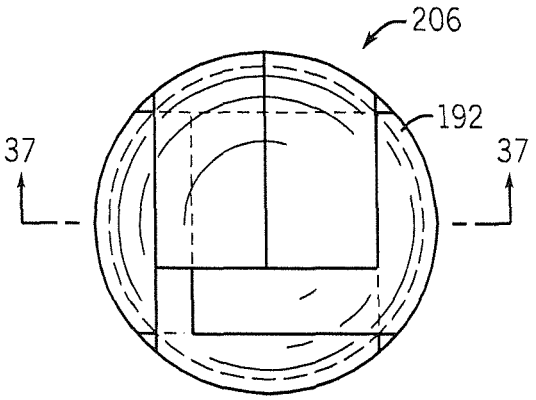
FIG. 36 is a top view of a muffler tube having an end that is closed folded tabs.
Figure 37:
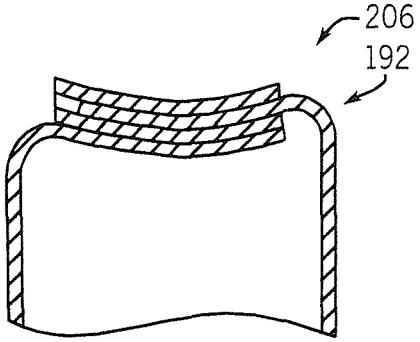
FIG. 37 is a view of Section 37-37 taken in FIG. 36.

Alternatively, as shown in FIGS. 36 and 37, the end portion 192 can have a curved or concave shape that is formed by using a post 34 having a top surface 42 that is concave and a center block 52 having a press surface 54 that is convex.

Figure 38:
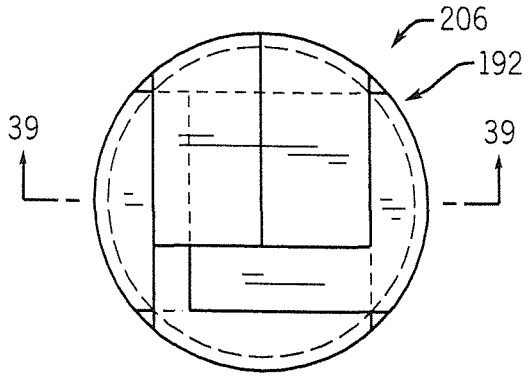
FIG. 38 is a top view of a muffler tube having an end that is closed by folded tabs.
Figure 39:
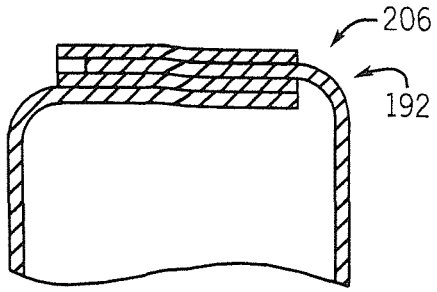
FIG. 39 is a view of Section 39-39 taken in FIG. 38.

Alternatively, as shown in FIGS. 38 and 39, the end portion 192 can be flat by using a post 34 having a top surface 42 that is flat and a center block 52 having a press surface 54 that is flat.

Figure 40:
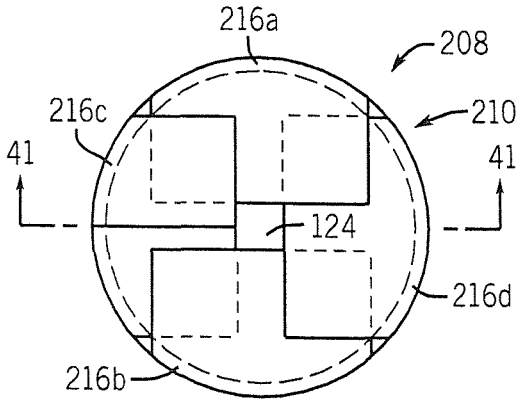
FIG. 40 is a top view of a muffler tube having an end that is closed folded tabs.
Figure 41:
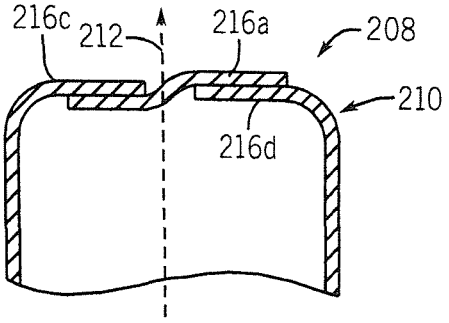
FIG. 41 is a view of Section 41-41 taken in FIG. 40.
Figure 42:
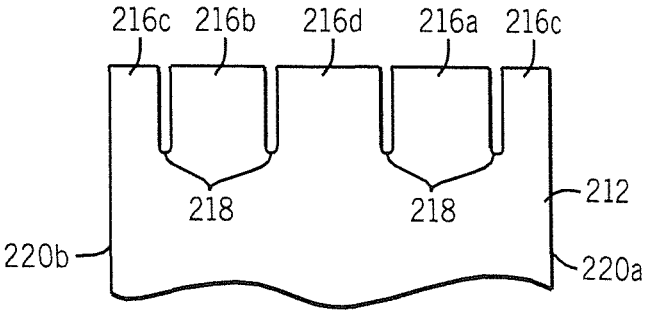
FIG. 42 is a front view of a sheet of material having tabs for forming the muffler tube of FIG. 40.

FIGS. 40-42 depict another example of a perforated muffler tube 208 having an end 210 that is closed by a plurality of folded tabs 216*a*-216*d*. FIG. 42 shows a sheet 212 of metal or other suitable material that is punched in a die, cut, or otherwise formed to have a top portion 214 with a plurality of outwardly extending tabs 216*a*-216*d*. Each tab is separated by adjacent tabs in the plurality by a slot 218. The tab 216*c* is formed out of two smaller tabs located on opposing side portions 220*a*, 220*b*. The sheet of material 212 is folded about a longitudinal axis 222 such that the side portions 220*a*, 220*b* are located adjacent each other. The side portions 220*a*, 220*b* are then connected to each other by welding or the like. Thereafter, the tabs 216*a*-216*d* are folded radially inward towards the longitudinal axis 222 to close the end 210 of the tube 208. In the example shown, each tab is folded inward so that it overlaps one adjacent tab in the plurality and is overlapped by one adjacent tab in the plurality. The tabs have a uniform height so that an aperture 124 is defined between the overlapping tabs.

The exemplary muffler tubes and methods of forming muffler tubes described herein provide many advantages over the prior art. In some examples, less material is used to close the end of the muffler tube, as compared to the prior art. The exemplary methods described herein are relatively easy to follow and therefore significantly decrease cost and labor necessary to form the muffler tube. The exemplary muffler tubes and methods described herein eliminate the need for plug flanges, which as mentioned above constitute an additional part that requires inventory and storage prior to assembly with the tube. Therefore, many of the muffler tubes and methods described herein provide a substantial cost savings over the prior art. In addition, many of the muffler tubes and methods described herein more efficiently utilize area in the tube for perforations. This provides significant functional advantages over the prior art.

What is claimed is:

1. A muffler tube extending generally in an axial direction, the muffler tube comprising an end portion with a plurality of outwardly extending tabs, wherein the tabs are folded radially inwards to at least partially close the end portion of the tube so that at least some of the tabs overlap in the axial direction and extend substantially normal to the axial direction.

2. The muffler tube of claim 1, wherein the overlapping tabs define an aperture in the end portion of the tube.

3. The muffler tube of claim 1, wherein the plurality of tabs comprises four tabs.

4. The muffler tube of claim 3, wherein adjacent tabs in the plurality are overlapped.

5. The muffler tube of claim 1, wherein the tabs are curved to give the end portion a concave contour.

6. The muffler tube of claim 1, wherein the tabs are curved to give the end portion a convex contour.

7. The muffler tube of claim 1, wherein the tube comprises a sheet of material that is folded about a longitudinal axis into the shape of a tube.

8. The muffler tube of claim 7, wherein the sheet of material comprises a plurality of perforations.

9. The muffler tube of claim 7, wherein the last least one of the tabs defines a through-hole.

10. The muffler tube of claim 9, wherein the through-hole is defined by a recess in one side portion of the sheet of material and a corresponding recess in an other side portion of the sheet of material, wherein the recesses are aligned.

11. The muffler tube of claim 1, wherein each tab in the plurality has a height that is large enough so that all of the tabs in the plurality overlap.

12. The muffler tube of claim 1, wherein at least some of the tabs in the plurality define a through-hole, wherein the through-hole of each tab is aligned with through-holes of other tabs in the plurality to define a passage in the end portion.

13. The muffler tube of claim 12, comprising a dimple formed in an uppermost tab of the plurality of tabs.

14. The muffler tube of claim 1, wherein some tabs in the plurality have a height that is small enough so that the tabs do not overlap when folded inward.

15. The muffler tube of claim 14, wherein some tabs in the plurality together form an outer layer on the muffler tube.

16. The muffler tube of claim 15, at least one tab in the plurality forms an inner layer on the muffler tube.

17. The muffler tube of claim 14, comprising first, second, third and fourth tabs, wherein the first tab is overlapped by the second tab and wherein the third and fourth tabs together overlap the second tab.

18. The muffler tube of claim 17, wherein the first and second tabs together define a passage in the end portion.

19. The muffler tube of claim 17, wherein the third and fourth tabs have a height that is smaller than the first and second tabs.

20. The muffler tube of claim 14, comprising first, second, third and fourth tabs, wherein the first and second tabs together form an inner layer on the muffler tube and wherein the third and fourth tabs together overlap the first and second tabs and form an outer later on the muffler tube.

21. The muffler tube of claim 1, comprising first, second, third and fourth tabs, wherein the first and second tabs together form an inner layer on the muffler tube and wherein the third and fourth tabs together overlap the first and second tabs and form an outer layer on the muffler tube.

22. The muffler tube of claim 21, wherein the inner layer forms a dimple and wherein the outer layer forms an aperture into which the dimple extends.

23. The muffler tube of claim 1, comprising first, second, third and fourth tabs, wherein the third tab has a larger height than the first and second tabs and wherein the fourth tab has a larger height than the third tab, and wherein the first and second tabs together overlap the fourth tab and wherein the third tab overlaps the first and second tabs.

24. The muffler tube of claim 1, wherein the plurality of tabs are flat to give the end portion a flat contour.

25. The muffler tube of claim 1, wherein each tab in the plurality overlaps an adjacent tab in the plurality and is overlapped by another adjacent tab in the plurality.

26. The muffler tube of claim 1, wherein an aperture is defined between the plurality of tabs.

27. The muffler tube of claim 1, wherein the end portion has two layers in cross-section.

28. The muffler tube of claim 1, wherein the end portion has three layers in cross-section.

29. The muffler tube of claim 1, wherein the end portion has four layers in cross-section.

* * * * *